US007921661B2

(12) United States Patent
Taras et al.

(10) Patent No.: US 7,921,661 B2
(45) Date of Patent: Apr. 12, 2011

(54) DEHUMIDIFICATION SYSTEM WITH MULTIPLE CONDENSERS AND COMPOUND COMPRESSOR

(75) Inventors: Michael F. Taras, Fayetteville, NY (US); Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 489 days.

(21) Appl. No.: 10/978,570

(22) Filed: Nov. 1, 2004

(65) Prior Publication Data

US 2006/0090501 A1 May 4, 2006

(51) Int. Cl.
*F25B 49/00* (2006.01)

(52) U.S. Cl. ..... 62/228.5; 62/228.1; 62/228.3; 62/228.4; 62/175; 62/196.1; 62/196.2; 62/173; 417/251; 417/252

(58) Field of Classification Search ..... 62/196.4, 62/197, 198, 199, 324.1, 498, 510, 90, 92, 62/93, 228.1, 228.3–228.5, 175, 196.1, 196.2, 62/173; 417/251, 252
See application file for complete search history.

(56) References Cited

U.S. PATENT DOCUMENTS 3,013,403 A * 12/1961 Grant et al. ..... 62/175
3,064,446 A * 11/1962 Dodge ..... 62/175
3,122,003 A * 2/1964 Sullivan ..... 62/157
4,246,759 A * 1/1981 Signoret ..... 62/77
5,634,348 A * 6/1997 Ikeda et al. ..... 62/160
5,651,258 A * 7/1997 Harris ..... 62/90
6,138,467 A * 10/2000 Lifson et al. ..... 62/217
6,378,318 B1 * 4/2002 Jin ..... 62/238.7
6,705,093 B1 * 3/2004 Taras et al. ..... 62/90
6,718,781 B2 * 4/2004 Freund et al. ..... 62/199
6,779,355 B2 * 8/2004 Tanaka ..... 62/192
6,986,264 B1 * 1/2006 Taras et al. ..... 62/513
7,062,930 B2 * 6/2006 Rayburn ..... 62/173
7,131,285 B2 * 11/2006 Lifson et al. ..... 62/196.4
2004/0037017 A1 * 2/2004 Lifson et al. ..... 361/22
2006/0080984 A1 * 4/2006 Lifson et al. ..... 62/228.5
2006/0090504 A1 * 5/2006 Taras et al. ..... 62/510

* cited by examiner

*Primary Examiner* — Henry C. Yuen
*Assistant Examiner* — Azim Rahim
(74) *Attorney, Agent, or Firm* — Carlson, Gaskey & Olds

(57) ABSTRACT

A refrigerant cycle is provided with a multi-port compressor or compressor stages connected in series, and multiple condensers. A single evaporator communicates with the plurality of condensers. At least one of the plurality of condensers receives fully compressed refrigerant while the other condensers receive refrigerant at intermediate pressure. A control can optionally direct refrigerant to the condensers to achieve desired system heat rejection characteristics and operating conditions. One or multiple reheat coils may be associated with the evaporator and are arranged either in series or in parallel to provide a desired dehumidification function and reheat stages. One or several of the intermediate pressure condensers may be utilized for the reheat function as well.

21 Claims, 2 Drawing Sheets

DEHUMIDIFICATION SYSTEM WITH MULTIPLE CONDENSERS AND COMPOUND COMPRESSOR

BACKGROUND OF THE INVENTION

This application relates to a refrigerant system having a common evaporator, but separate condensers where at least one of the condensers is connected to an intermediate pressure compression stage, while the other condenser is connected to a high pressure compression stage, and wherein a reheat coil is incorporated into the refrigerant cycle.

Refrigerant systems are utilized in applications to change the temperature and humidity or otherwise condition the environment. In a standard refrigerant system, a compressor delivers a compressed refrigerant to a heat exchanger, known as a condenser, which is typically located outside. From the condenser, the refrigerant passes through an expansion device, and then to an indoor heat exchanger, known as an evaporator. At the evaporator, moisture may be removed from the air, and the temperature of air blown over the evaporator coil is lowered. From the evaporator, the refrigerant returns to the compressor. Of course, basic refrigerant cycles are utilized in combination with many configuration variations and optional features. However, the above provides a brief understanding of the fundamental concept.

Refrigerant cycles are known, wherein a so-called economizer circuit is incorporated. In an economizer circuit, a first refrigerant line is tapped from a main refrigerant line downstream of the condenser. The tapped refrigerant line is passed through an expansion device, and then the tapped refrigerant and the main refrigerant both flow through an economizer heat exchanger. The tapped refrigerant subcools the main refrigerant, such that when the main refrigerant reaches an evaporator, it will have a greater cooling potential. The tapped refrigerant, having subcooled the main refrigerant, is returned to the compressor at an intermediate compression point.

In some cases, while the system is operating in a cooling mode, the temperature level at which the air is delivered to provide a comfort environment in a conditioned space may need to be higher than the temperature that would provide the ideal humidity level. Generally, lower the temperature of the air stream more moisture can be removed from this air stream. However, lowering the air temperature below certain level is undesirable. This has presented challenges to refrigerant system designers. One way to address such challenges is to utilize various schematics incorporating reheat coils that will increase the air temperature. In many cases, a reheat coil placed in the way of an indoor air stream behind the evaporator is employed for the purposes of reheating the air supplied to the conditioned space after it has been cooled in the evaporator, and where the moisture has been removed.

While reheat coils have been incorporated into air conditioning systems, they have not been utilized in an air conditioning system having an ability to reject heat at multiple temperature levels.

The present invention employs the flow of refrigerant from an intermediate compression point in a compressor to selectively provide refrigerant to at least one of a plurality of condensers, where each of the condensers operate at different temperature levels. In this manner, the heat rejection characteristics of the refrigerant cycle can be controlled to provide enhanced flexibility to a refrigerant cycle designer. Also, improved dehumidification function is provided by incorporating a reheat coil into the refrigerant system.

SUMMARY OF THE INVENTION

In the proposed system design, a portion of the refrigerant, compressed to some intermediate pressure, leaves the compressor through an intermediate compressor port, while the rest of the refrigerant vapor continues through the compression process to a main discharge port and then to a first (main) condenser. The refrigerant that leaves the intermediate port is connected to another (second) condenser. Consequently, for such a system an additional temperature level of heat rejection is available. Such heat rejection capability at various temperature levels can be utilized in multiple industrial applications where condensers are located in different environments. For example, the main condenser can be located outdoors, while the second condenser is located indoors. Another application would be for heat pump installations, where there are two environmental chambers each requiring a different amount of heating. The amount of refrigerant flowing through each condenser can be regulated by expansion devices, as explained below. In the present invention, a refrigerant system is provided with a common evaporator receiving refrigerant from at least two condensers. The evaporator is associated with one or more reheat coils.

In several embodiments, there may be more than one compressor connected in series, or a single compressor can selectively deliver refrigerant to the two condensers. In case of several compressors connected in series, the intermediate port, as described above, can simply be positioned in a line connecting the lower pressure compressor to a higher pressure compressor.

In yet another embodiments, there may be more than two condensers operating at more than two different temperature levels.

In still another embodiments, one of the condensers itself may be utilized for the reheat function.

These and other features of the present invention can be best understood from the following specification and drawings, the following of which is a brief description.

DETAILED DESCRIPTION OF THE PREFERRED EMBODIMENT

Figure 1:
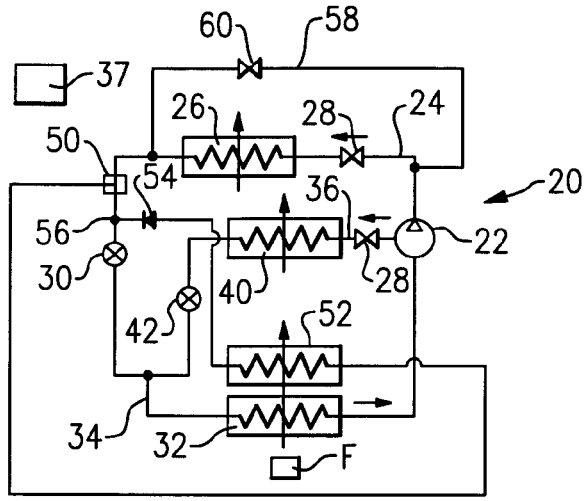
FIG. 1 is a first schematic.

FIG. 1 shows a refrigerant system 20 having a single compressor 22 delivering compressed refrigerant to a discharge line 24. Discharge line 24 communicates with a first condenser 26. Refrigerant passes through an optional shut-off valve 28, through the condenser 26 and then through an expansion device 30. At a connection 34, refrigerant is received downstream of the expansion device 30, and delivered to an evaporator 32. The refrigerant from the evaporator 32 returns to the compressor 22. An intermediate pressure tap line 36 passes through an optional shut-off valve 28, and delivers an intermediate pressure refrigerant to a second condenser 40. The shut-off valve 28 can be closed if under some operating conditions there is a need to route all of the refrigerant entering the compressor 22 through a discharge line 24. Otherwise, the shut-off valve 28 would normally be open. An expansion device 42 is positioned downstream of condenser 40. The refrigerant would be at a distinct temperature and pressure in the condenser 40 from what it is in the condenser 26. The two condensers can be utilized to provide more effective control over the overall operation of the refrigerant system and to cover a wider spectrum of potential applications. As mentioned above, there would be reasons why a worker of ordinary skill in the art would want to have greater control over the heat rejection characteristics of the refrigerant system 20.

A control 37 controls the various devices and components in the refrigerant system 20 to achieve the desired characteristics.

The system described above is disclosed and claimed in U.S. patent application Ser. No. 10/963484, filed on Oct. 12, 2004, now U.S. Pat. No. 7,131,285, and entitled "Refrigerant Cycle With Plural Condensers Receiving Refrigerant at Different Pressures."

In addition, the present invention incorporates a reheat coil 52 into the refrigerant system 20. As shown, a three-way valve 50 selectively taps refrigerant from a main refrigerant flow line through the reheat coil 52. Downstream of the reheat coil 52, the refrigerant passes through a check valve 54, and rejoins the refrigerant in the main circuit at a point 56 downstream of the three-way valve 50. As is known, the reheat coil 52 is positioned to be in the path of flow of air driven by an air-moving device such as fan F having moved air over the evaporator 32 and toward the environment to be conditioned. As is known, the air is cooled and dehumidified in the evaporator 32, and may be cooled to a temperature below that which would be desirable for an environment to be conditioned.

The air is reheated above the temperature imparted to the air in the evaporator 32 by the relatively hot refrigerant in the reheat coil 52 to provide a desired comfort temperature level in the environment to be conditioned.

As is clear from the FIG. 1, the refrigerant passing through the condensers 26 and 40 pass through their separate expansion devices 30 and 42, then reconnect at a common manifold line 34 before being delivered to the evaporator 32. Refrigerant from the two lines flows to the evaporator, and does not pas through the other condenser. As mentioned above, the operation and arrangement allows the two condensers 26 and 40 to operate at distinct temperatures. This is provided by the distinct pressure refrigerants being delivered to the condensers 26 and 40, namely with a higher pressure refrigerant passing from the discharge line 24 to the condenser 26, partially compressed refrigerant passing through the line 36 to the condenser 40.

In addition, a bypass line 58 and a shut-off valve 60 allows refrigerant to bypass the condenser 26. This option is utilized when dehumidification is desired without significant cooling. A worker of ordinary skill in the art would recognize how to utilize the control 37 to selectively operate the bypass valve 60 to achieve a desired system condition.

As known, all flow control devices such as the three-way valve 50 and valves 28 and 60 may be of a conventional shut-off or adjustable type. Also, the three-way valve 50 may be substituted by a pair of conventional valves.

Figure 2A:
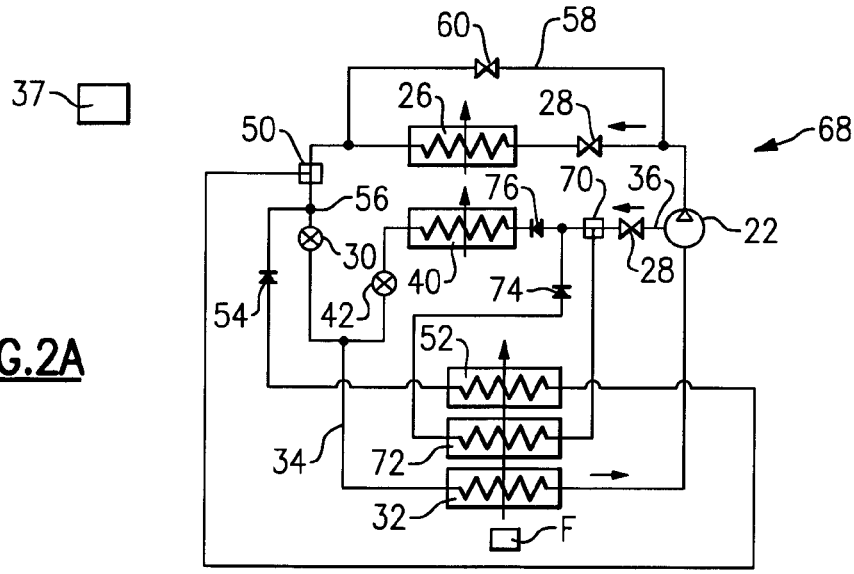
FIG. 2A is a second schematic.
Figure 2B:
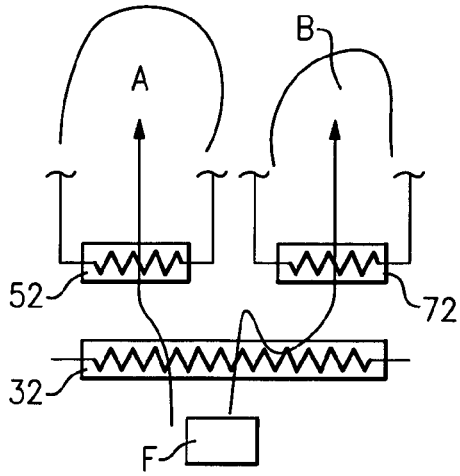
FIG. 2B shows an option.

FIG. 2A shows another embodiment 68, which is similar to the refrigerant system 20. However, in the schematic 68, there is a second reheat coil 72 that receives refrigerant from a three-way valve 70, with the refrigerant passing through the reheat coil 72, through a check valve 74, and rejoins the intermediate pressure refrigerant line at a point 76. The control 37 can selectively operate either one, both or neither of the reheat coils 52 and 72, as system demands require. Having two reheat coils 52 and 72 enhances dehumidification capability and control flexibility of the refrigerant system 68, allowing for two stages of reheat. Of course, if the flow control devices of adjustable type are implemented, an infinitely variable control of the reheat function can be executed. Although the reheat coils are shown in the FIG. 2A to be arranged in series, as shown in FIG. 2B, they also can be applied in parallel in relation to the airflow such as one portion of the airflow passes through one reheat coil and another portion flows through another reheat coil. In the latter case, each portion of the airflow can be associated with a respective sub-environment A or B as shown. Obviously, in all the cases, a portion of air can bypass both reheat coils if desired.

Of course, many modifications of these two disclosed schematics are possible. Alternatives to the three-way valves may be utilized, and various locations for tapping the refrigerant to the reheat coil may be employed. In other words, the specifics of the reheat schematic is not essential here and is transparent to the teachings of this invention. The combination of condensers operating at different temperature levels and a reheat function is inventive and beneficial for the system operation, control, and application coverage.

Of course, other multiples of compressors and compressor banks as well as condensers operating at various temperature levels can be utilized within the scope of this invention. Also, a single compressor may have more than one intermediate pressure tap or multiple compression stages may be connected in series, providing capability for the system to operate at multiple temperature levels.

Figure 3:
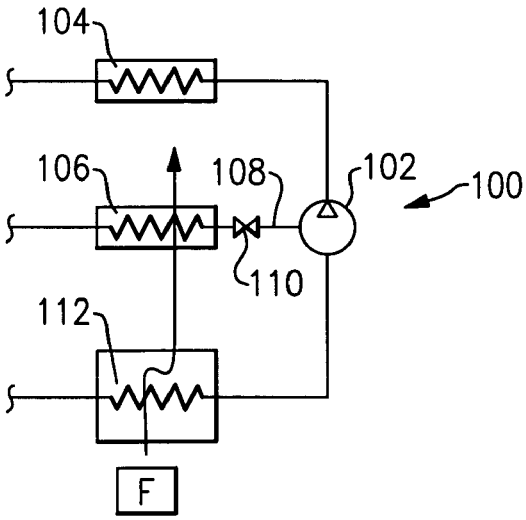
FIG. 3 shows a third schematic

FIG. 3 shows another schematic 100 in which a compressor 102 delivers compressed refrigerant to a downstream condenser 104. A second condenser 106 receives refrigerant from an intermediate pressure port 108. A flow control device such as valve 110 is placed on the refrigerant line connected to the port 108. An evaporator 112 is downstream of the condensers, similar to the prior embodiments. As shown, the condenser 106 is placed in the path of air driven over the evaporator 112, such that the condenser 106 provides the function of a reheat coil in this embodiment.

Figure 4:
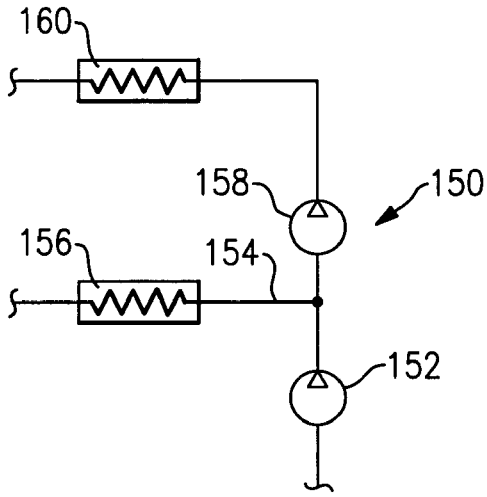
FIG. 4 shows an option.

FIG. 4 shows another option 150, wherein a single compressor with a tap at intermediate pressure is replaced by a two-stage compressor system with a lower stage compressor 152 delivering refrigerant to a discharge line leading to a higher stage compressor 158. The tap 154 is tapped between the two stages and leads to the intermediate pressure condenser 156. The high pressure condenser 160 receives refrigerant compressed by the high stage compressor 158. In all other aspects this schematic is similar to the previous embodiments.

Figure 5:
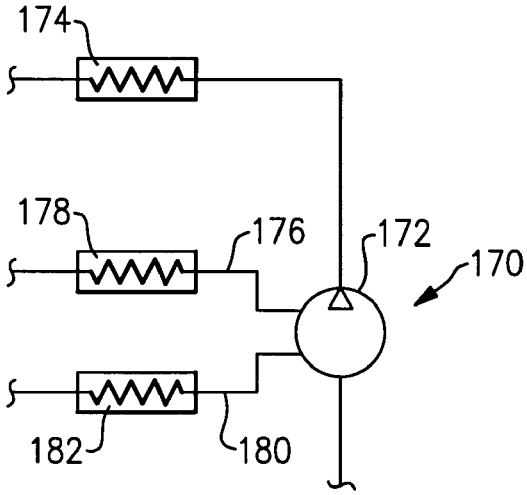
FIG. 5 shows another option.

FIG. 5 shows another option 170 in which a single compressor 172 compresses refrigerant and delivers it to a downstream condenser 174. There are a pair of intermediate pressure taps 176 and 180 each delivering intermediate pressure refrigerant at distinct pressures to downstream condensers 178 and 182, as shown. This schematic allows the system high pressure side to operate at three distinct temperature levels.

The options illustrates in FIGS. 3-5 provide more flexibility and control to a designer of refrigerant cycles. Of course, more than three compressors or compressor banks as well as condensers operating at different temperature levels can also be utilized within the scope of this invention. Also, the several disclosed embodiments can function in either a heat pump mode or air conditioning mode, depending whether the evaporator and condenser are respectively located indoors or outdoors.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

at least one compressor delivering a refrigerant to a first condenser from a discharge line and at a relatively high pressure, said refrigerant from said first condenser passing through an expansion device, and downstream to an evaporator, said refrigerant from said evaporator returning to said compressor; and an intermediate pressure tap for tapping said refrigerant from said compressor at an intermediate compression point, the tapped refrigerant being at a relatively low pressure compared to said relatively high pressure, said refrigerant from said intermediate pressure tap passing through a second condenser, said refrigerant having passed through said second condenser passing through an expansion device and to said evaporator, and from said evaporator back to said compressor; and a reheat coil associated with said evaporator.

2. The refrigerant system as set forth in claim 1, wherein there is only one said compressor delivering refrigerant to said discharge line and to said intermediate pressure tap.

3. The refrigerant system as set forth in claim 1, wherein said at least one compressor is a pair of compressors connected in series, with a refrigerant being delivered downstream of a high pressure compressor to said first condenser, and from a location intermediate of said two compressors providing refrigerant to said intermediate pressure tap.

4. The refrigerant system as set forth in claim 1, wherein a control selectively controls a delivery of said refrigerant from said at least one compressor to each of said first and second condensers.

5. The refrigerant system as set forth in claim 1, wherein a separate reheat coil is associated with each of said condensers.

6. The refrigerant system as set forth in claim 5, wherein each of said reheat coils receives said refrigerant from a separate tap.

7. The refrigerant system as set forth in claim 1, wherein a bypass line allows selective bypass of the condenser.

8. The refrigerant system as set forth in claim 1, wherein there is at least a third condenser.

9. The refrigerant system as set forth in claim 8, wherein there are at least three reheat coils.

10. The refrigerant system as set forth in claim 1, wherein said second condenser is also utilized as a reheat coil by being placed in the path of air flowing over said evaporator.

11. The refrigerant system as set forth in claim 1, wherein the refrigerant in the discharge line is at a distinct pressure than the refrigerant in the intermediate pressure tap.

12. The refrigerant system as set forth in claim 1, wherein said refrigerant from said first and second condensers being reconnected downstream at a single line leading to said evaporator, and with said refrigerant from said second condenser not passing through said first condenser.

13. The refrigerant system as set forth in claim 12, wherein a distinct expansion device is positioned downstream of said first and second condensers such that said refrigerant passing downstream of said first condenser passes through one expansion device, and said refrigerant passing through said second condenser passes through a distinct expansion device.

14. The refrigerant system as set forth in claim 12, wherein the operational temperatures of said first and second condensers being different due to the distinct pressure of the refrigerants passing through said first and second condensers.

15. A method of operating a refrigerant system comprising the steps of:

1) delivering a compressed refrigerant to a first condenser from at least one compressor having an intermediate pressure tap for delivering a partially compressed refrigerant to a second condenser, said refrigerant from both said first and second condensers passing through a common evaporator and back to at least said one compressor, and providing a reheat coil associated with said evaporator; said compressed refrigerant delivered to said first condenser being at a higher pressure than the partially compressed refrigerant delivered to the second condenser; and 2) operating said refrigerant cycle by selectively routing said refrigerant from said at least one compressor to said first and second condensers and selectively directing said refrigerant to said reheat coil.

16. The method as set forth in claim 15, further comprising the steps of providing a bypass around said first condenser, and selectively bypassing said refrigerant around said first condenser.

17. The method as set forth in claim 15, wherein said second condenser is placed in the path of airflow over said evaporator such that said second condenser operates as a reheat coil.

18. The method as set forth in claim 15, wherein the refrigerant in the discharge line is at a distinct pressure than the refrigerant in the intermediate pressure tap.

19. The method as set forth in claim 15, wherein said refrigerant from said first and second condensers being reconnected downstream at a single line leading to said evaporator, and with said refrigerant from said second condenser not passing through said first condenser.

20. The method as set forth in claim 19, wherein a distinct expansion device is positioned downstream of said first and second condensers such that said refrigerant passing downstream of said first condenser passes through one expansion device, and said refrigerant passing through said second condenser passes through a distinct expansion device.

21. The method as set forth in claim 19, wherein the operational temperatures of said first and second condensers being different due to the distinct pressure of the refrigerants passing through said first and second condensers.

* * * * *